US009868006B1

(12) United States Patent
Epler

(10) Patent No.: US 9,868,006 B1
(45) Date of Patent: Jan. 16, 2018

(54) FITNESS BAR APPARATUS, SYSTEMS AND METHODS

(71) Applicant: Chris Epler, Merritt Island, FL (US)

(72) Inventor: Chris Epler, Merritt Island, FL (US)

( * ) Notice: Subject to any disclaimer, the term of this patent is extended or adjusted under 35 U.S.C. 154(b) by 44 days.

(21) Appl. No.: 15/053,380

(22) Filed: Feb. 25, 2016

(51) Int. Cl.
*A63B 1/00* (2006.01)
*A63B 23/12* (2006.01)
*A63B 21/068* (2006.01)
*A63B 21/00* (2006.01)

(52) U.S. Cl.
CPC ..... *A63B 1/00* (2013.01); *A63B 21/068* (2013.01); *A63B 21/4035* (2015.10); *A63B 23/1218* (2013.01)

(58) Field of Classification Search
CPC ..... A63B 1/00; A63B 21/4035; A63B 21/068; A63B 23/1218
USPC ..... 482/40
See application file for complete search history.

(56) References Cited

U.S. PATENT DOCUMENTS 4,620,701 A 11/1986 Mojden
5,011,139 A 4/1991 Towley, III
5,180,350 A 1/1993 Thomas
5,372,556 A 12/1994 Ropp
5,417,628 A 5/1995 Vanderbleek
5,776,033 A * 7/1998 Brown ..... A63B 1/00 248/317
5,871,422 A 2/1999 Elbogen
6,179,748 B1 1/2001 Barr
6,503,175 B1 1/2003 Harrell
6,514,182 B1 2/2003 Chhloeum
6,705,974 B1 3/2004 Tardif
7,044,896 B2 5/2006 Hetrick
7,090,622 B2 8/2006 Hetrick
7,108,636 B1 9/2006 Garcia
7,651,448 B2 1/2010 Hetrick
7,651,449 B1 1/2010 Balentine
7,722,508 B2 5/2010 Hetrick
7,762,932 B2 7/2010 Hetrick
7,785,244 B2 8/2010 Hetrick
7,806,814 B2 10/2010 Hetrick
7,892,157 B2 2/2011 Arnett
8,043,197 B2 10/2011 Hetrick
8,083,653 B2 12/2011 Hetrick
8,197,392 B2 6/2012 Silverman et al.
8,469,864 B2 6/2013 Hetrick
8,808,147 B2 8/2014 Gillespie et al.
8,814,762 B2 8/2014 Butler et al.
8,876,679 B2 11/2014 Demarco et al.
8,944,976 B2 2/2015 Crowell et al.
8,979,716 B1 3/2015 Rawlins
8,992,395 B2 3/2015 Orakwusi
8,998,750 B2 4/2015 Sullivan et al.
(Continued)

*Primary Examiner* — Andrew S Lo
(74) *Attorney, Agent, or Firm* — Brian S. Steinberger; Law Offices of Brian S. Steinberger, P.A.

(57) ABSTRACT

Assemblies, systems, devices, and methods for attaching a pull up and cross pull up bars to a clamp assembly which is equally clamped to both sides of a door frame above a doorway, with or without additional straps and cords supporting a suspended bar for the performance of exercises; and stand-alone racks with straps and cords supporting a suspended bar used for the performance of exercises; and existing bars or structural members with straps and cords supporting a suspended bar used for the performance of exercises.

18 Claims, 14 Drawing Sheets

(56) References Cited

U.S. PATENT DOCUMENTS

| | | | | |
|---|---|---|---|---|
| 9,079,085 | B2 | 7/2015 | McBride et al. | |
| 9,114,273 | B2 | 8/2015 | Kehoe et al. | |
| 2013/0165298 | A1* | 6/2013 | Demsey | A63B 21/00047 482/40 |
| 2013/0217544 | A1* | 8/2013 | Anaya | A63B 21/1627 482/40 |
| 2013/0225373 | A1* | 8/2013 | Poat | A63B 21/1636 482/40 |
| 2015/0148197 | A1* | 5/2015 | Lentz | A63B 1/00 482/40 |

* cited by examiner

Clamp Assembly Reacting Frictional Force

FITNESS BAR APPARATUS, SYSTEMS AND METHODS

FIELD OF INVENTION

This invention relates to chin up and pull up bars, and in particular to assemblies, systems, devices, and methods for clamping a pull up bar assembly, with multiple grip locations for performance of exercises, to both sides of a door frame above a doorway, with or without additional straps and cords supporting a suspended bar used for the performance of exercises; and stand-alone racks with straps and cords supporting a suspended bar used for the performance of exercises; and existing bars or structural members with straps and cords supporting a suspended bar used for the performance of exercises.

BACKGROUND AND PRIOR ART

Various types of exercise devices exist that can be used with a residential doorway. A common device used to perform pull-up or chin up exercises is constructed of a frame for which one part is placed above the trim of one side of the doorway, allowing a second part of the frame, which is wider than the doorway, to rotate down and rest against the trim on the sides of the doorway. The user's load is divided between these trim areas. This version has several flaws. First the load from the user typically causes the side decorative trim to be damaged by the frame load, even when mitigating devices are employed. A second flaw is that this mounting arrangement does not provide a positively secured device. There is possible inadvertent displacement of the first part of the frame that rests above the doorway, causing the frame and the user to unexpectedly fall, potentially injuring the user. Another flaw with this version is that, since the user portion of the frame is always opposite the door hinge side of the doorframe, and the door hinge is typically on the room-side of the doorway, the user is almost always performing exercises in the hallway. This can be a problem if the hallway is being used by others, or if the user prefers to use a room as the place of exercise. Another flaw is that there is a single point of failure of the device: should the door trim on one side of the door not be properly constructed to support load, or if it becomes compromised due to overuse, the device and user will fall if the said door trim fails.

Another prior art device requires the door to be closed, and an anchor is placed between the closed door and the door jamb. Attached to the anchor are elastic or inelastic straps with handles and foot loops for which the user, where the user leaning or suspending their body weight away from the anchor, creates resistance for executing a plurality of exercises. The user positions either their hand (hands) into handles, or foot (feet) into looped straps below the handles, which are attached to the straps. The anchor, straps, and user is typically located on the side of the doorway where the door does not swing, i.e., if the door swings into a room, as most do, the safest position to place the anchor and use the device is in the hallway, such that the anchor load causes the door to be pulled into the jamb, not away from it. The adjustment of the handles, which is needed to perform a plurality of exercises by changing the distance of the handle to the anchor point, is typically executed by utilizing a cam buckle or similar device cinched upon the strap with the handle at the halfway point, such that for every unit of distance the cam buckle is moved, the handle moves half that amount. The handles are typically rigidly attached to the strap, and the strap is continuous between the handles, such that the load from one handle is reacted by the load from the other handle.

This device also has several flaws. First, since the door must be closed to utilize the device, the amount of resistance the user can impart of the selected body part during an exercise is limited since the placement of the feet or hands is limited, i.e., the feet or hands cannot be placed under or past the door frame. Second, since there are individual straps for each appendage, there is large degree of freedom on a spherical course of each individual strap. This can put excessive strain on the joints of the appendage and negatively affect all but the most-fit user. Third, given the above-mentioned requirement for safe anchoring, the user may be required to use the device in a hallway, space permitting. If the user does choose to exercise on the room-side of the doorway, the user must open the door and remove the device to exit the room, and re-set up the device when returning to complete their exercise regimen. Fourth, should someone else inadvertently open the door while a user is exercising inside a room, the device will no longer be anchored potentially causing user injury. Fifth, the above stated means for which the device is adjusted, there is an inherent limitation on the overall distance the handles can be adjusted, limiting the overall range of exercises that can be performed with the device. Sixth, engagement of the user's foot (feet) into the foot straps can be difficult given that the looped strap is not rigid and moves when attempting to properly place the foot (feet) in to the loop. Seventh, since in most cases the handles do not rotate, strain can be placed on the wrists when executing exercises whereby the arms rotate about the elbows or shoulders. Eighth, since the strap is continuous from handle to handle and each handle load reacts with the other, if one hand or foot becomes inadvertently disengaged, the other hand or foot quickly moves downward due to gravity until a secondary mechanism, if it exists, stops further movement of the handle. This situation and subsequent quick handle movement has been known to cause user injury.

The invention presented here has all the positive benefits of pull up and suspended body weight exercises without the aforementioned flaws.

SUMMARY OF THE INVENTION

This invention relates to chin up and pull up bars, and in particular to assemblies, systems, devices, and methods for clamping a pull up bar assembly, with multiple grip locations for performance of exercises, to both sides of a door frame above a doorway, with or without additional straps and cords supporting a suspended bar used for the performance of exercises; and stand-alone racks with straps and cords supporting a suspended bar used for the performance of exercises; and existing bars or structural members with straps and cords supporting a suspended bar used for the performance of exercises.

A secondary objective of the present invention is to provide assemblies, systems, devices, and methods for clamping a pull up and cross pull up bars to both sides of a door frame above a doorway, which rigidly clamps to both sides of a doorway trim via a screw mechanism which creates tension between rigid and rotating portions of the frame. A user's bodyweight is reacted via frictional forces of the clamped frame on the wall, and the ledge bars on the trim of both sides of the doorway. The result is a very secure device to execute pull ups, chin ups, and other body weight exercises.

A third objective of the present invention is to provide assemblies, systems, devices, and methods for providing pull up and chin up bars, which allows the user to position their body directly under and beyond the attach point when utilizing the suspension bar, maximizing the resistance imparted when executing a plurality of different exercises. Exercises such as suspended arm and suspending leg push-ups directly under the attach point are possible.

A fourth objective of the present invention is to provide assemblies, systems, devices, and methods for providing pull up and chin up bars, which consists of a single bar suspension bar whereby its degree of freedom is limited to single-plane rotational movement about the anchor point, conducive to efficiently executing strength, high intensity, plyometric, and other modes of exercise, while minimizing potential for user injury.

A fifth objective of the present invention is to provide assemblies, systems, devices, and methods for providing pull up and chin up bars, which consists of a suspension bar that can be quickly and repeatedly adjusted a large distance from the anchor point due to the cam buckle/strap arrangement, and graduated marks on the straps.

A sixth objective of the present invention is to provide assemblies, systems, devices, and methods for providing pull up and chin up bars, which allows the user to quickly and comfortably engage their feet onto the suspension bar via usage of a cushioned block between the foot or leg and suspension bar.

A seventh objective of the present invention is to provide assemblies, systems, devices, and methods for providing pull up and chin up bars, which consists of a suspension bar that can quickly be adjusted to be horizontal with the floor, facilitating equal loading of hands or feet during exercise.

An eighth objective of the present invention is to provide assemblies, systems, devices, and methods for providing pull up and chin up bars, which consists of a suspension bar that freely rotates about the axis of the user's grip, minimizing strain on the wrists.

A ninth objective of the present invention is to provide assemblies, systems, devices, and methods for providing pull up and chin up bars, which can be configured to be installed on standard (approximately 4½") and load bearing (approximately 6½") wall widths, or wall widths in that approximate range, as well as standard and wide door trim widths.

A tenth objective of the present invention is to provide assemblies, systems, devices, and methods for providing pull up and chin up bars, which allows the user to quickly stow the bar and enter/exit the room of the doorway where the device is installed during exercise sessions.

An eleventh objective of the present invention is to provide assemblies, systems, devices, and methods for providing pull up and chin up bars, which allows the user to perform exercises on either side of the doorway A twelfth objective of the present invention is to provide assemblies, systems, devices, and methods for providing pull up and chin up bars, which can be securely affixed to a bar provided by others by wrapping around the bar, with the J hook secured onto the cam buckle.

A thirteenth objective of the present invention is to provide assemblies, systems, devices, and methods for providing pull up and chin up bars, which can be securely affixed to a standalone suspension exercise frame, which has a slot to receive the suspension bar J hook.

In this application, a pull up is performed when the user has hands placed on a bar, with the palms of their hands facing away from the user, and utilizes their arms, shoulders, and torso to elevate their body weight. A chin up is the same activity, with the exception that the palms are facing towards the user. An alternate version of a pull up, the neutral grip pull up, is when the hands are placed on parallel bars, with palms facing, to while utilizing their arms, shoulder, and torso to elevate their body weight.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
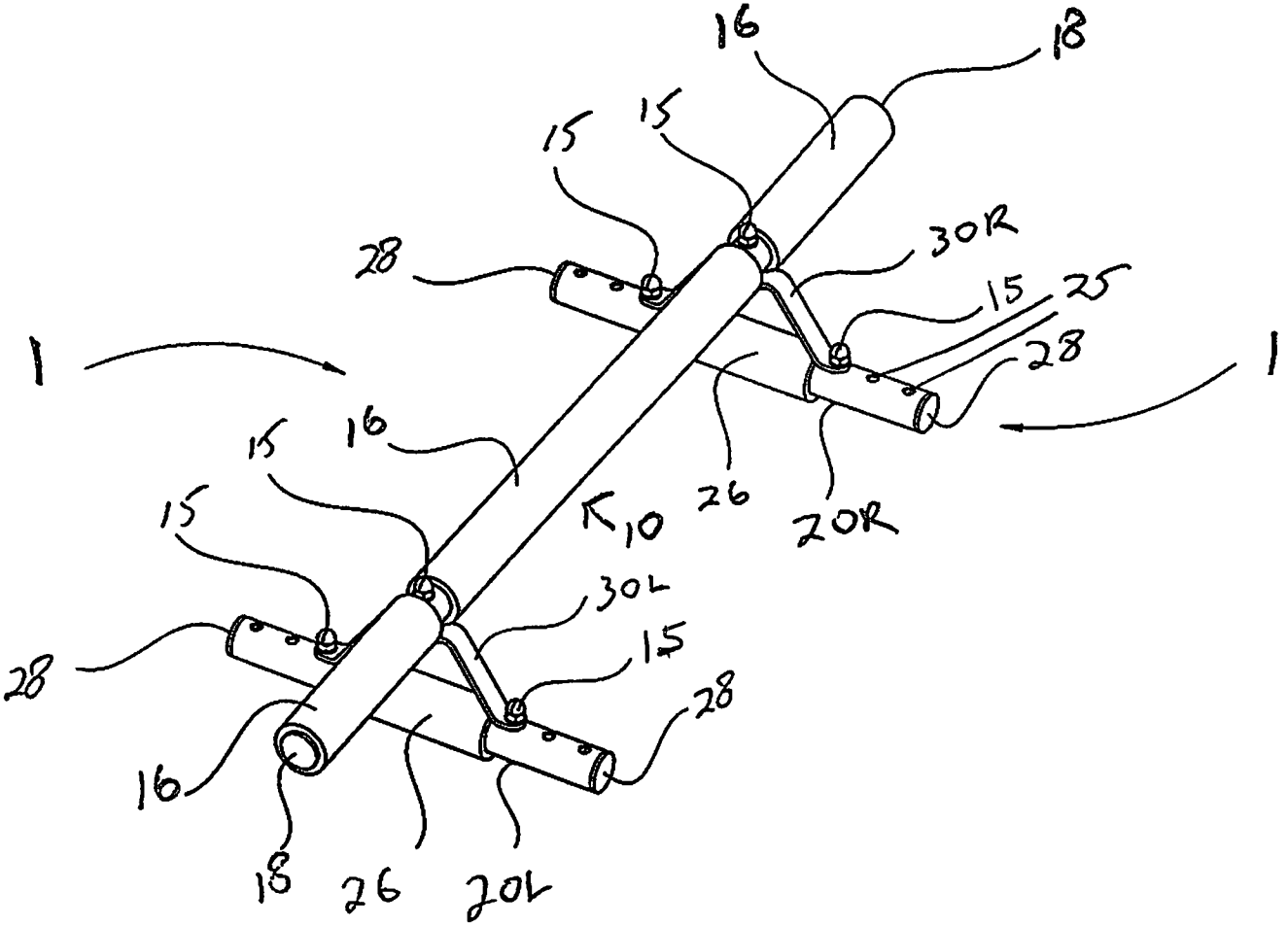
FIG. 1 is an upper perspective view of the main pull up bar with cross bars assembly
Figure 2:
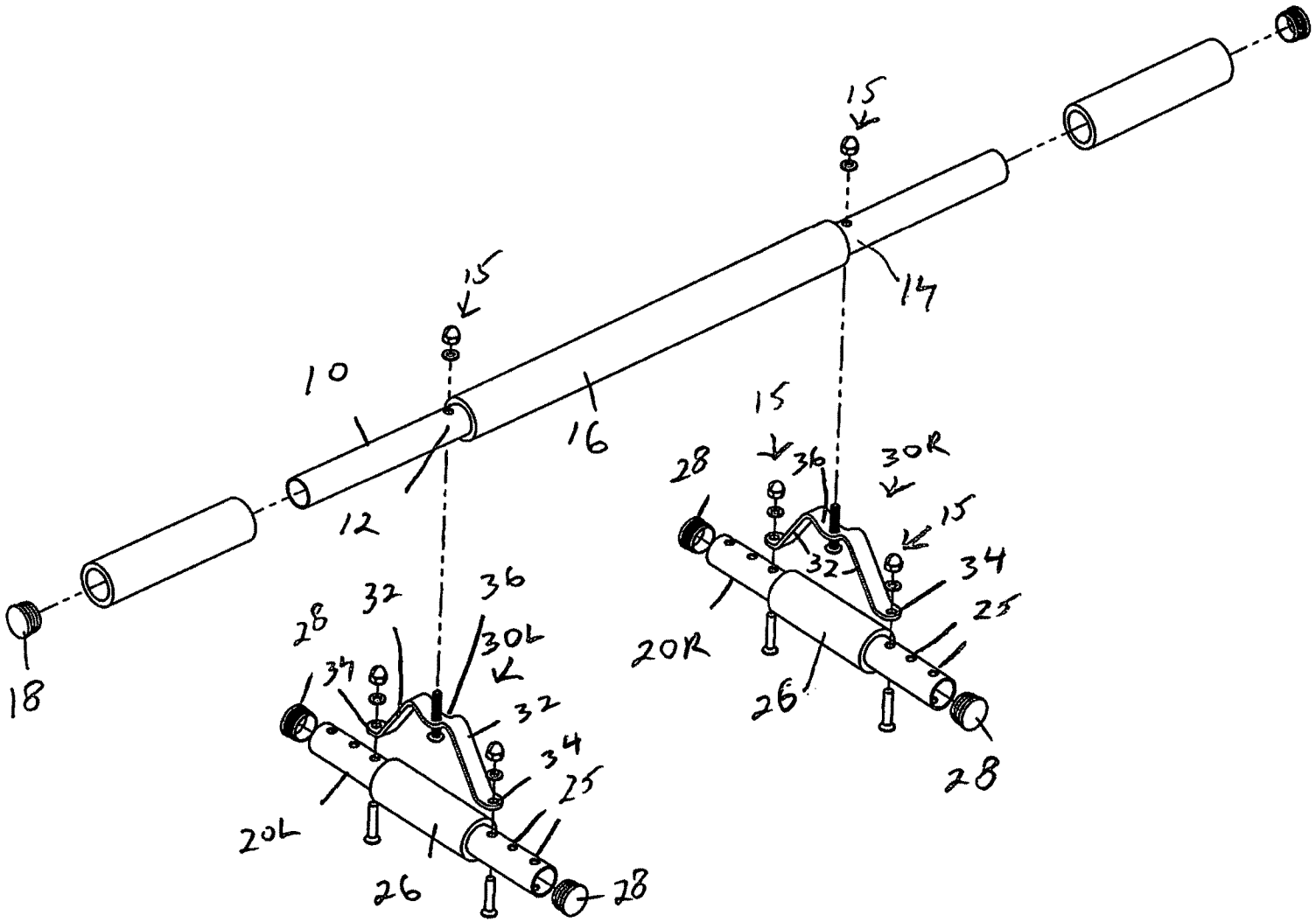
FIG. 2 is an exploded view of the main pull up bar with cross bars assembly of FIG. 1.

1 main pull up bar and cross bars assembly
10 main pull up bar
12 left end portion
14 right end portion
15 fasteners, such as screws/bolts, washers and nuts
16 cushion, such as but not limited to foam grip
18 end caps
20L left cross bar
20R right cross bar
25 through-holes to adjust space distance between vertical posts
26 cushions, such as but not limited to foam grips
28 end caps
30L left M bracket
30R right M bracket
32 angled legs
34 footers
36 indented mid portion
38 end caps
50 hooks for storing suspension bar
70 door frame
72 door trim
74 wall above door trim
100 Clamp and pull up assembly
110 First horizontal clamp ledge member
112 left end portion
114 right end portion
115 fasteners, such as screws/bolts, nuts and washers
118 end caps
119 slots for hooks 205L, 205R
120 Second horizontal clamp ledge member
122 left end portion
124 right end portion
128 end caps
130 first set of vertical support posts
131 through-holes for hooks 50
133 through-holes for height adjustment of ledge bar 110
136 rounded spacer with through hole
137 bolts/screws
138 end caps
140 second set of vertical support posts
143 through-holes to adjust height of ledge bar 120
146 inserts with perpendicular threaded holes
147 through-holes
148 end caps
150 threaded clamping bar(s)/rod(s)
152 knobs and nuts
154 nuts and washers
156 bumpers
200 suspension bar with straps and cord assembly
205L left strap hook
205R right strap hook
210L first left strap
215L left cam buckle
220L second left strap
210R first right strap
215R right cam buckle
220R second right strap
225L left strap ring
225R right strap ring
230 cord
232 cord loop end(s)
240 Suspension bar
242 hollow tube
244 cushion sleeve(s), such as foam grips and the like.
248 cushion blocks
300 rack/stand
310 left rack leg
315 left rack footer
320 right rack leg
325 right rack footer
330 front horizontal beam
335 slots for suspension bar strap hooks
340L left grip dip accessory
340R right grip dip accessory
400 prior art pull up bar FIG. 1 is an upper perspective view of the main pull up bar with cross bars assembly 1. FIG. 2 is an exploded view of the main pull up bar with cross bars assembly 1 of FIG. 1.

Figure 4:
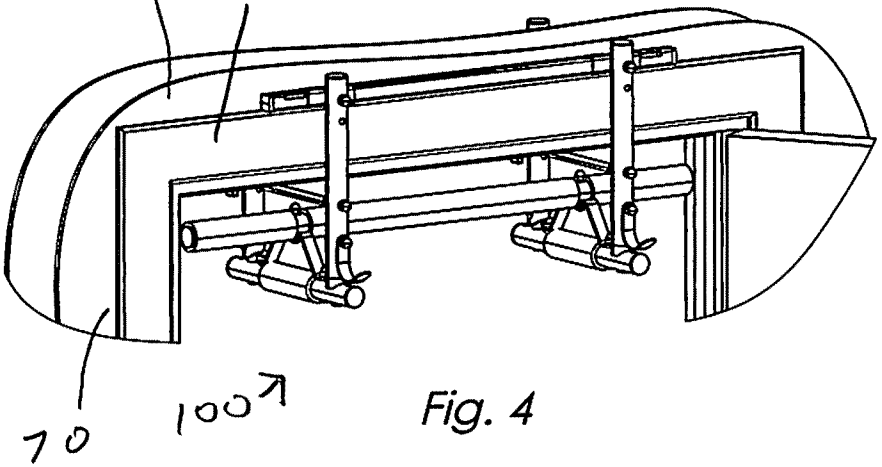
FIG. 4 is an enlarged view of the main pull up bar with cross bars assembly and clamp assembly clamped about both sides of a door frame above the trim shown in FIG. 3.
Figure 3:
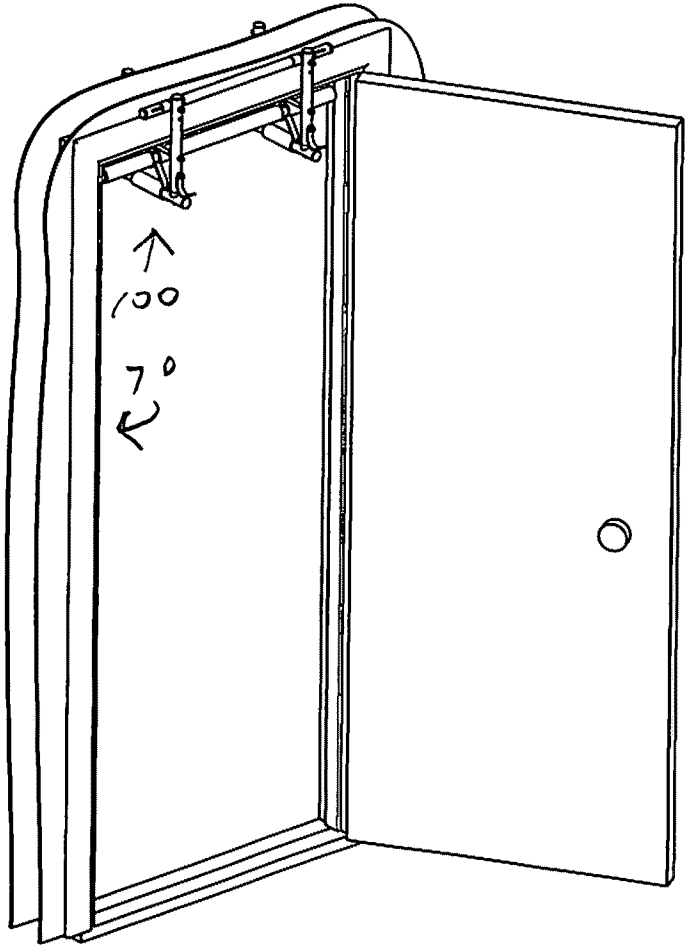
FIG. 3 is a perspective view of the main pull up bar with cross bars assembly of FIG. 2 with clamp assembly clamped about both sides of a door frame above the trim.
Figure 5B:
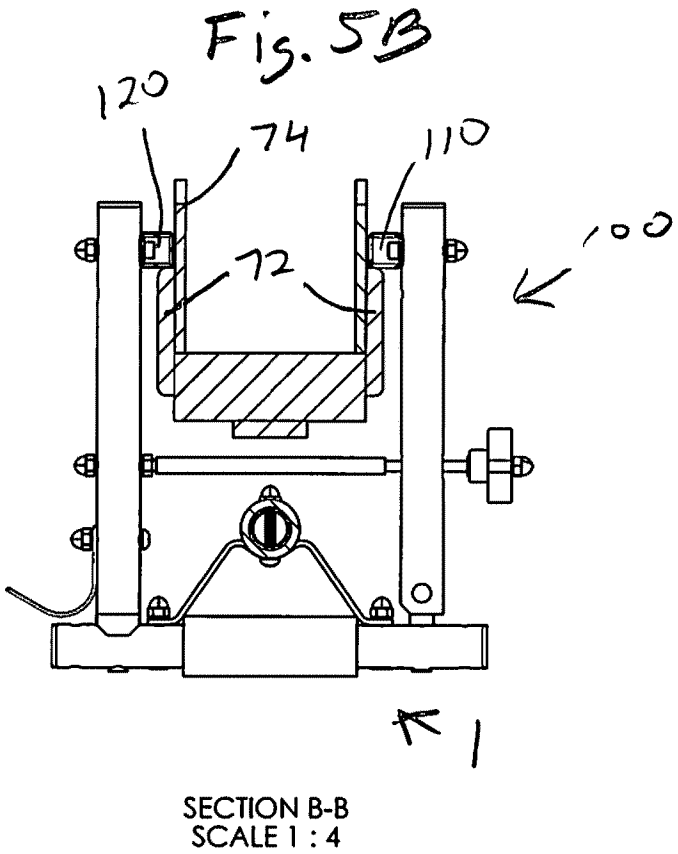
FIG. 5B is an enlarged cross-sectional view of FIG. 5 along arrows 5B.
Figure 5A:
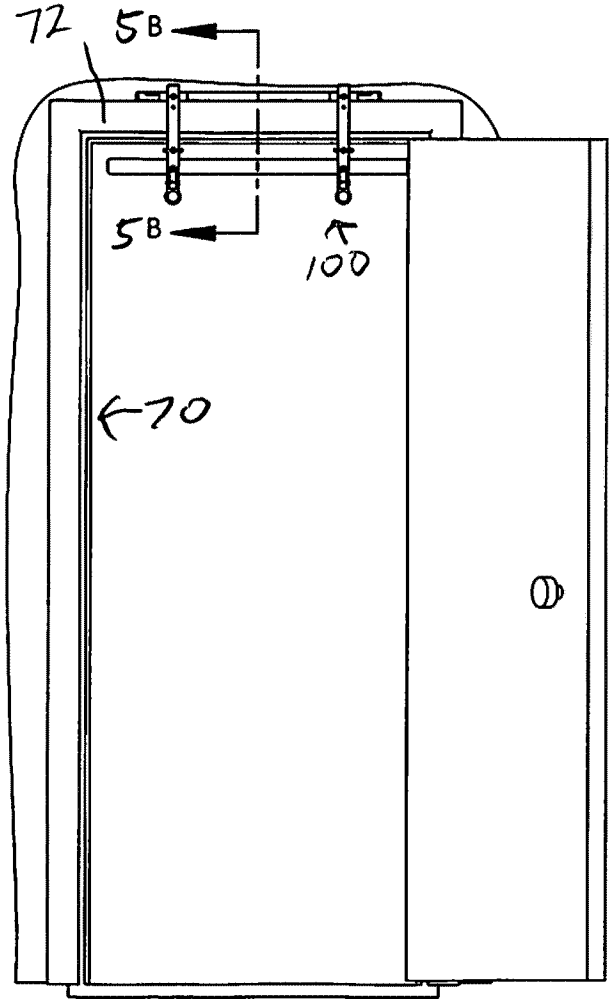
FIG. 5A is a front view of the main pull up bar with cross bars assembly and clamp assembly clamped about both sides of a door frame above the trim shown in FIG. 3.

FIG. 3 is a perspective view of the main pull up bar with cross bars assembly 1 of FIG. 2 with clamp assembly 100 clamped about both sides of wall 74 of a door frame 70 above the trim 72. FIG. 4 is an enlarged view of the main pull up bar with cross bars assembly 1 and clamp assembly 100 clamped about both sides of wall 74 of a door frame 70 above the trim 72 shown in FIG. 3. FIG. 5A is a front view of the main pull up bar with cross bars assembly 1 and clamp assembly 100 clamped about both sides of wall 74 of a door frame 70 above the trim 72 shown in FIG. 3. FIG. 5B is an enlarged cross-sectional view of FIG. 5 along arrows 5B.

Figure 6:
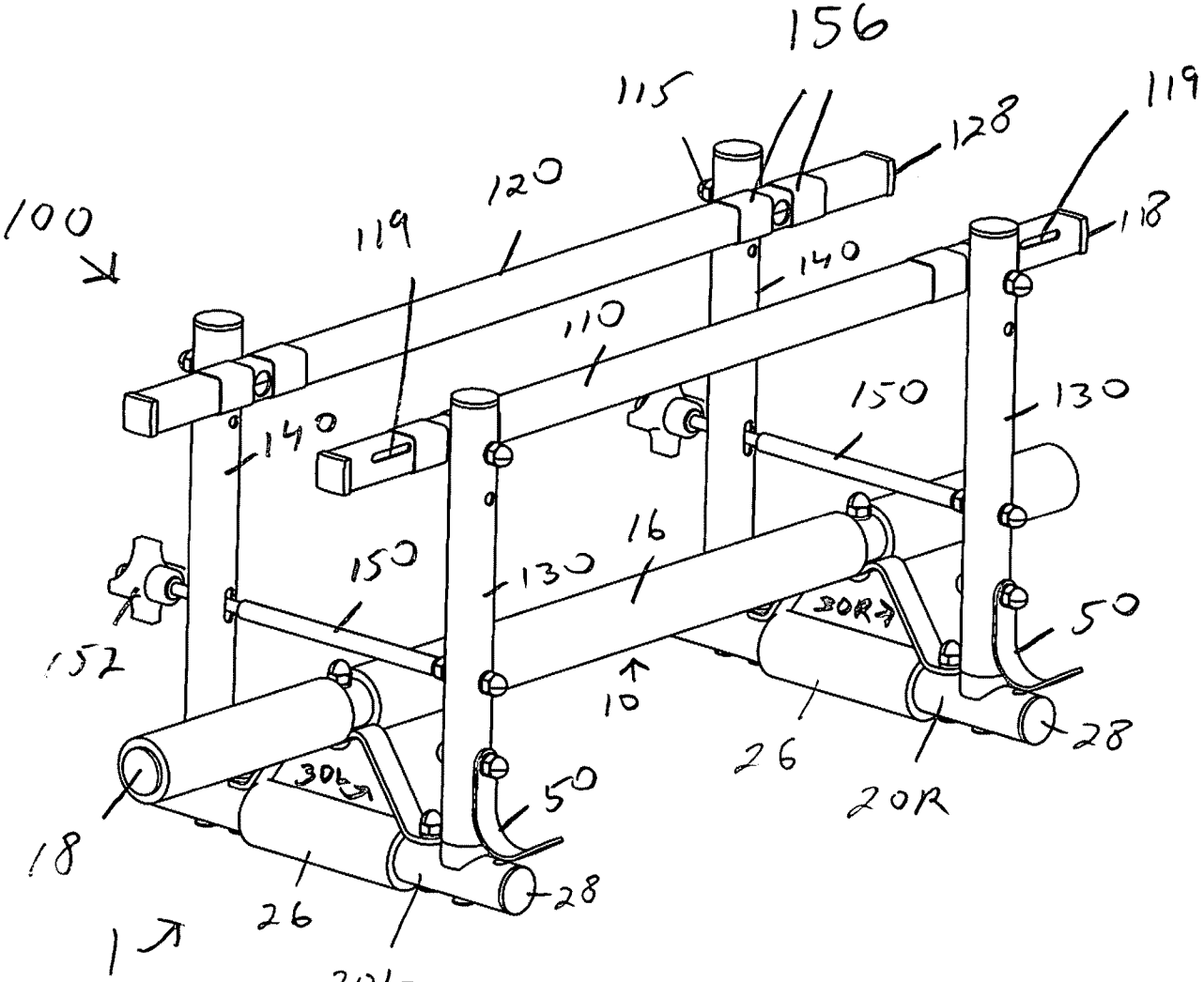
FIG. 6 is a front perspective view of the main pull up bar with cross bars assembly and clamp assembly shown in FIGS. 3-5.
Figure 7:
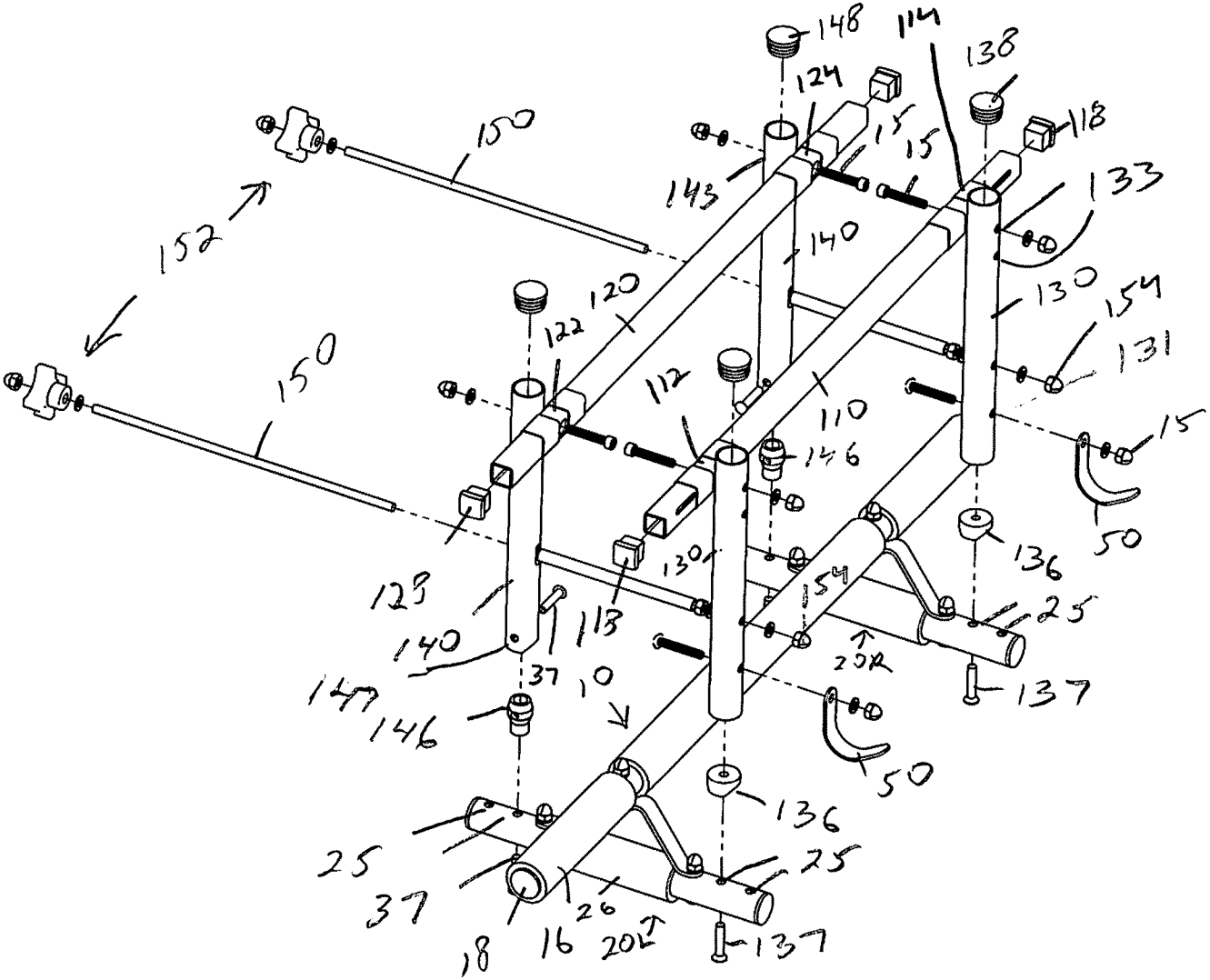
FIG. 7 is an exploded view of the main pull up bar with cross bars assembly and clamp assembly shown in FIG. 6.
Figure 8:
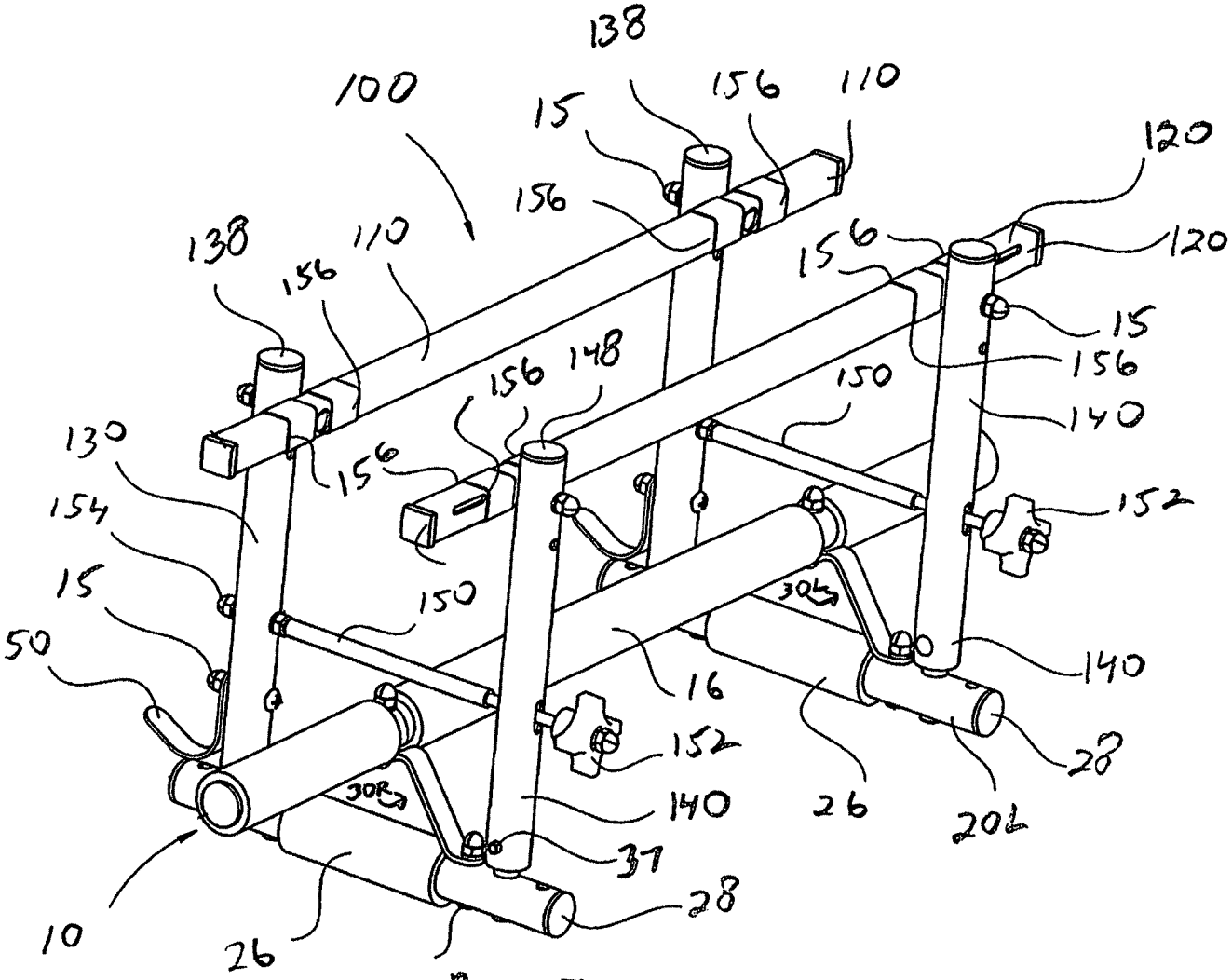
FIG. 8 is a rear perspective view of the main pull up bar with cross bars assembly and clamp assembly shown in FIGS. 6-7.

FIG. 6 is a front perspective view of the main pull up bar with cross bars assembly 1 and clamp assembly 100 shown in FIGS. 3-5. FIG. 7 is an exploded view of the main pull up bar with cross bars assembly 1 and clamp assembly 100 shown in FIG. 6. FIG. 8 is a rear perspective view of the main pull up bar with cross bars assembly 1 and clamp assembly 100 of FIGS. 6-7.

Referring to FIGS. 1-2, the main pull up bar and cross bars assembly 1, can include an elongated main pull up bar 10 with end caps 18 at both ends, and a plurality of cushion(s) 16, such as but not limited to foam grips, and the like, can be wrapped thereabout. An indented mid portion 36 of a left M shaped bracket 30L can attach to a left end portion 12 of the main bar 10 by fasteners 15 that can include screws/bolts, nuts and washers. A left cross bar 20L can be attached to footers 34 extending from angled legs 32 of the left M shaped bracket 30L by fasteners 15. An indented mid portion 36 of a right M shaped bracket 30R can attach to a right end portion 14 of the main bar 10 by fasteners 15 that can include screws/bolts, nuts and washers. A right cross bar 20R can be attached to footers 34 extending from angled legs 32 of the right M shaped bracket 30R by fasteners 15. Each of the cross bars 20L, 20R can have end caps 28 at outer ends. Cushions 18, such as but not limited to foam grips and the like, can be wrapped about the cross bars 20L, 20R.

Referring to FIGS. 1, 2 and 6-8, the main pull up bar and cross bars assembly 1 can be attached to the clamp assembly 100 by two sets of vertical posts 130, 140. The installer can select front side through-holes 25 in each of the cross bars 20L, 20R to screw fasteners 37 (such as bolts, screws), to pass into the selected front through-holes 25 and into the threaded openings in the rounded spacer 136 and are threaded into the bottom ends of the first set of vertical posts 130. Similarly, the installer can select rear side through-holes 25 in each of the cross bars 20L, 20R to screw fasteners 37 to pass into the selected rear through-holes 25 and into the lower threaded openings in the tube inserts 146 and to screw fasteners 37 into through-holes 147 of vertical posts 140 and into side perpendicular threaded openings in the tube inserts 146. The different through-holes 25 in the cross bars 20L, 20R can be selected based on the different wall thicknesses of the door frames that the clamp assembly 100 is to be clamped thereto. For example, 4½ and 6½ inch thick walls, or smaller or larger can be clamped with the clamp assembly 100.

A first horizontal clamp ledge member 110 can be attached by fasteners 15 (such as screws/bolts, nuts and washers) fastening into through-holes 133 in the upper ends of the first set of vertical posts 130. Similarly second horizontal clamp ledge member 120 can be attached by fasteners 15 (such as screws/bots, nuts and washers) fastening into through-holes 143 in the upper ends of the second set of vertical posts 140. The upper ends of vertical posts 130, 140 can be closed off with end caps 138, 148, respectively. Similarly, end caps 118, 128 can be closed off with end caps 110, 120. Threaded bars/rods 150 with knobs 152 at one end and nuts and washers 154 at an opposite end can pass through through-holes and through slots in vertical post sets 130 140, and be used for clamping the assembly 100 about the door frame. Bumpers, of a soft or semi-soft and non-marking material, can be installed on ledge bars 110 and 120, for interface of assembly 100 to the wall 74 and trim 72.

Referring to FIGS. 3-8, the installer can position the clamp assembly 100 with main pull up bar and cross bars assembly 1 about both sides of a door frame 70 above the door trim 72, preferably against the wall surfaces 74 above the trim 72. The installer can rotate the knobs 152 to so that the clamp assembly 100 equally applies pressure on both sides of the door frame 170 so that any load weight below the door frame is equally distributed on both sides of the door frame 70 and on the trim 72 on both sides of the door frame 70.

The installation of the novel clamp assembly 100 with pull up bar and cross bar assembly 1 will now be described.

The users determines cross bar hole locations by measuring the thickness of the wall where the installation is desired. A 6½" wide wall requires use of the outer cross bar holes, while a 4½" wide wall requires use of the inner cross bar holes. For wall widths in between, the user may utilize one set of outer and on set of inner holes. The users determined the width. If trim is standard trim size (2½" or less width) the user uses the lower set of through holes 133. If trim is a wide trim size (2½" to 3½" width) the user uses the upper set of through holes 133.

The user installs ledge bar 110 and hooks 50 to vertical posts 130 with fasteners and adds ancillary bumpers and caps. This subassembly is attached to the pre-assembled main pull up bar and crossbar assembly 1 in the holes selected above using rounded spacer 136 and fasteners. The user installs ledge bar 120 and to vertical posts 140 with fasteners and adds ancillary bumpers and caps. This subassembly is attached to the pre-assembled main pull up bar and crossbar assembly 1 in the holes selected above with fasteners.

The user installs a threaded rod 150 through the vertical posts 130 and 140. The user installs knobs 152 at the end of two stud and fasteners.

User Installation of Pull Up Assembly

The user determines which side of the doorway they prefer to perform exercises. The user recognizes that vertical post 130 is to be oriented on this side of the doorway.

The user picks up assembly 100, rotates vertical ledge bars 140 open, lifts the assembly such that the ledge bars 110 and 120 are past the door trim Lift Pull Up bar overhead placing ledge bars past the top of trim 72, rotates vertical ledge bars 140 closed, and tightens knobs 150 hand tight.

The novel clamp assembly 100 with pull bar and cross bars assembly 1 has the following benefits.

1. Attaches to both sides of door trim via rotating member clamping against a rigid member.
2. Attaches to both sides of door trim, providing equal loading onto said door trim
3. Includes screw mechanism that positively attaches the apparatus to the door frame eliminating the potential for inadvertent un-attachment
4. Includes two screw mechanisms that provide a progressively increasing vertical Frictional Force ($F_f$) between the apparatus and the wall with increasing torque input, proportionally reducing the load imparted onto the door trim ($F_t$), reference FIG. 21.
5. Includes a pull up bar used for narrow/wide grip pull ups/chin ups that is raised above two cross bars which is used for normal grip (palms facing) pull ups
6. Allows the user to perform pull-ups/chin ups in a bidirectional fashion (i.e. the user can face into or out of the room where the doorway is positioned)
7. Provides slots for which suspension straps can be positively attached without inadvertent removal during normal use
8. Provides slots positioned such that it distributes the suspension strap downward load to a point nearly directly above the partially reacting wall trim
9. Provides two hooks for quick stowage of the suspension bar while the Pull Up bar is still installed.

Figure 10:
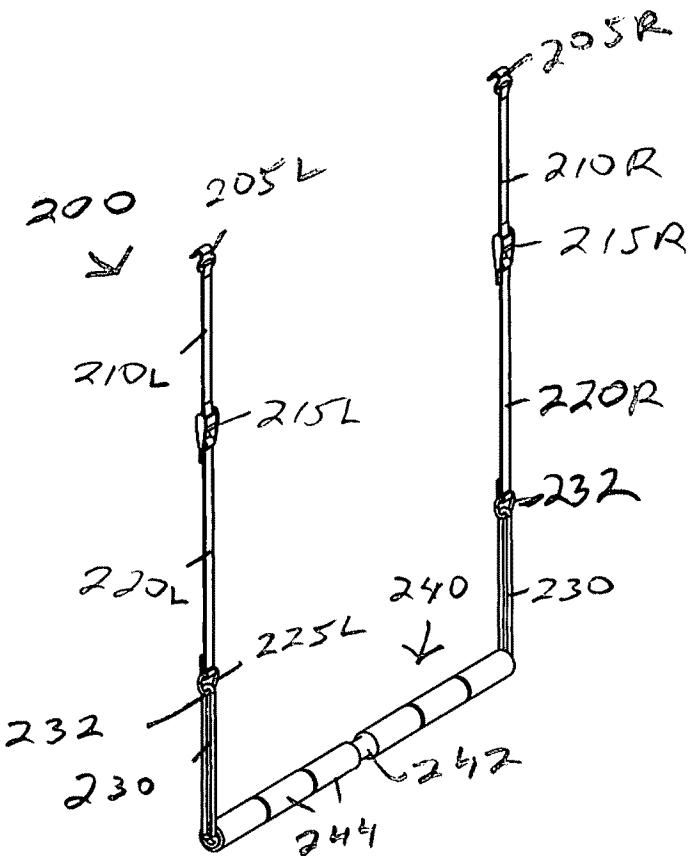
FIG. 10 is an enlarged view of the suspension bar assembly with straps and cord(s) of FIG. 9.
Figure 9:
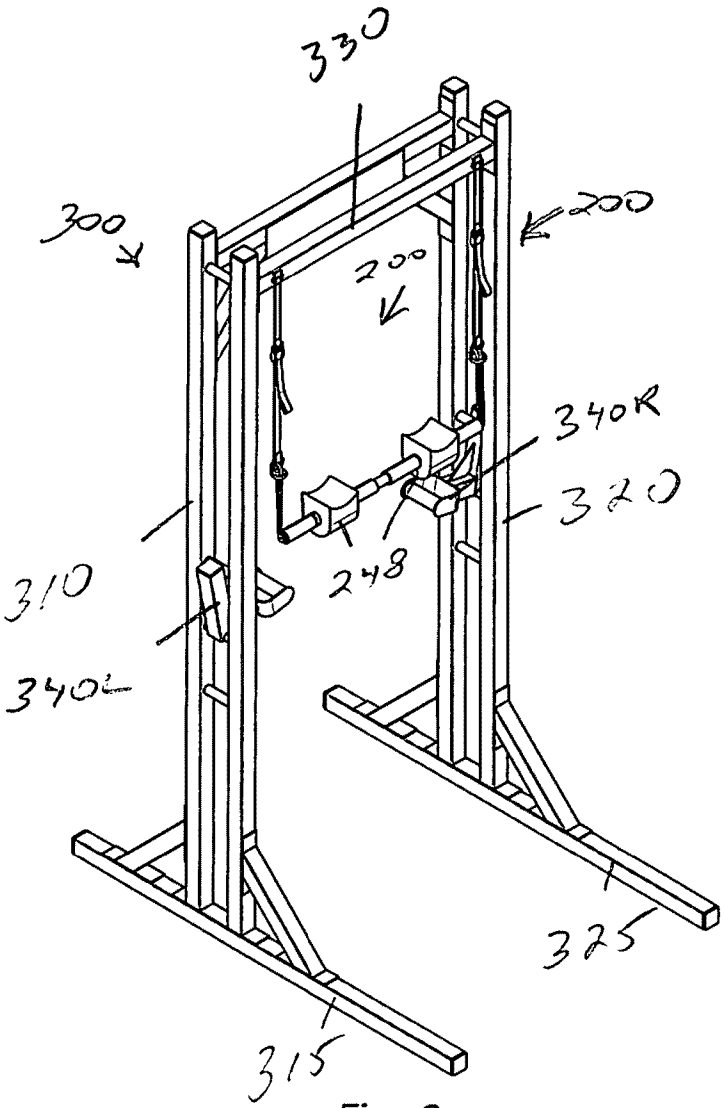
FIG. 9 is a perspective view of a rack/stand assembly with suspension bar assembly and arm/leg cushions.
Figure 11:
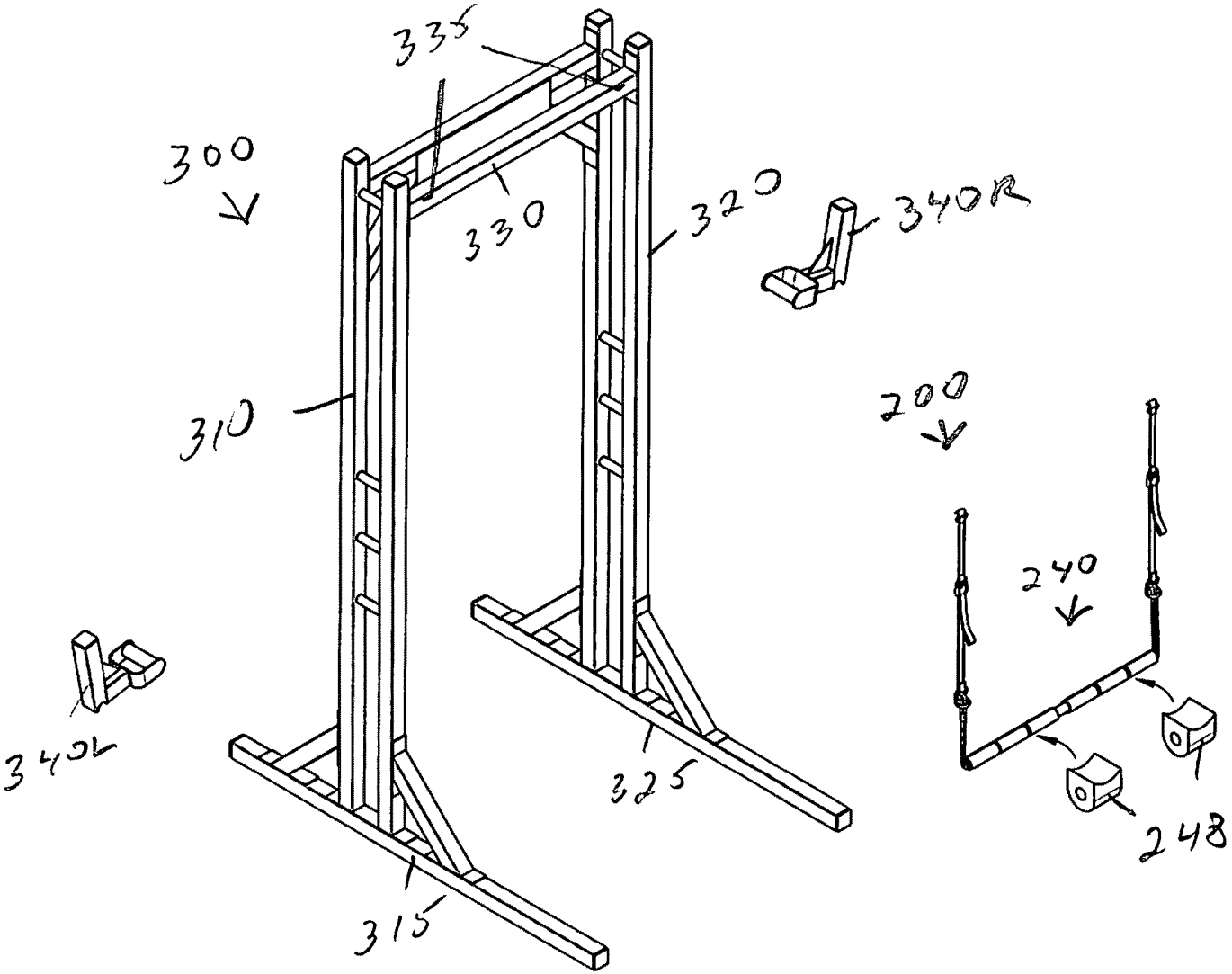
FIG. 11 is an exploded view of the rack/stand assembly and suspension bar assembly with main straps, cord(s) and arm/leg cushions of FIG. 9.
Figure 12:
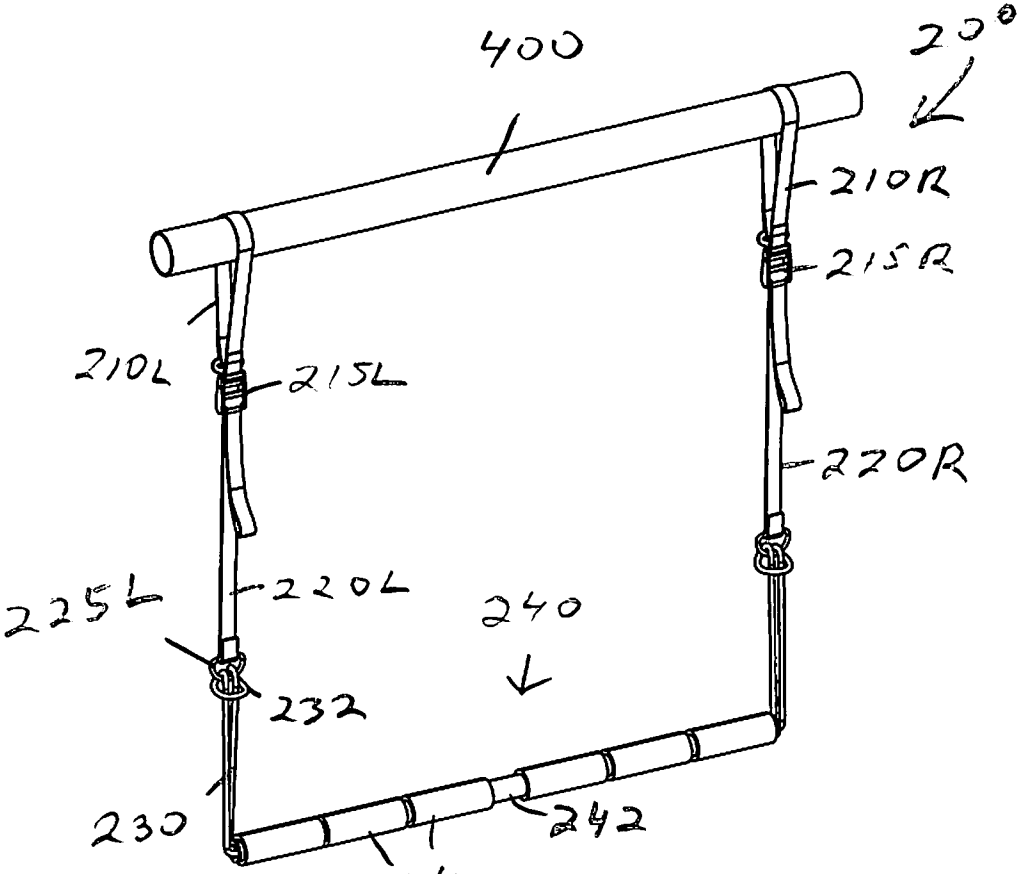
FIG. 12 is a perspective view of the suspension bar assembly with straps and cord(s) of FIG. 10 hanging from a prior art rigid pull up bar.

FIG. 9 is a perspective view of a rack/stand assembly 300 with suspension bar assembly 200. FIG. 10 is an enlarged view of the suspension bar assembly 200 with straps 210L, 210R, 220L, 220R and cord(s) 230 of FIG. 9. FIG. 11 is an exploded view of the rack/stand assembly 300 and suspension bar assembly 200 with straps 210L, 210R, 220L, 220R, cord(s) 230 and elbow cushions 248 of FIG. 9. FIG. 12 is a perspective view of the suspension bar assembly 200 with straps 210L, 210R, 220L, 220R and cord(s) 230 of FIG. 10 hanging from a prior art rigid pull up bar 400.

Figure 13:
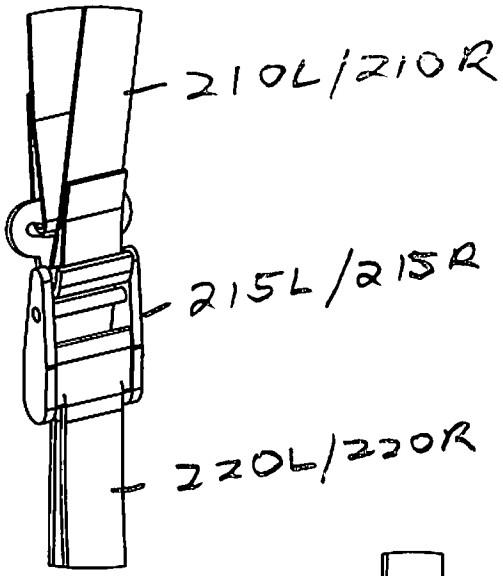
FIG. 13 is an enlarged view of the cam buckle(s) attached to the straps used in the embodiments of FIGS. 9-12 and FIGS. 15-16.
Figure 14:
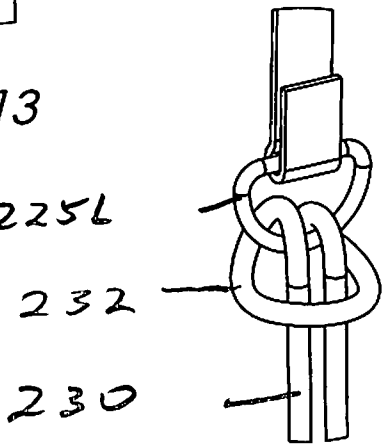
FIG. 14 is an enlarged view of the strap hook(s) with cords transition used in the embodiments of FIGS. 9-12.

FIG. 13 is an enlarged view of the cam buckle(s) 215L, 215R attached to the straps 210L, 210R, 220L, 220R, used in the embodiments of FIGS. 9-12. FIG. 14 is an enlarged view of the strap hook(s) 205L, 205R with cords 230, 232 transition used in the embodiments of FIGS. 9-12.

FIGS. 9-11 and 13-14, a suspension bar assembly 200 can include a left strap hook 205L that can be attached to an upper end of a first left strap 210L, with a lower end of the first left strap 210L wrapped through a left cam buckle 215L, which can adjust the length of the first left strap 210L. The upper end of a second left strap 220L can be attached to the cam left cam buckle 215L with a lower end attached by a ring 225L to a loop end 232 of a cord 230, which can be a rope and the like. The suspension bar assembly 200 can also include a right strap hook 205R that can be attached to an upper end of a first right strap 210R, with a lower end of the first right strap 210R wrapped through a right cam buckle 215R, which can adjust the length of the first right strap 210R. The upper end of a second right strap 220R can be attached to the cam right cam buckle 215R with a lower end attached by a ring 225R to a loop end 232 of the cord 230.

A suspension bar 240 can include a hollow tube 242, which can rotate and slide side to side over the cord 230. The cord(s) 230 wrapped about the tube 242 can be cushion sleeve(s) 244, such as foam grips and the like. Additionally, cushion blocks 248 for supporting legs or arms, can be wrapped about or placed upon the suspension bar 240.

Referring to FIGS. 9-11 and 13-14, the rack/stand 300 can include a left rack leg 310 over a left rack footer 315, and a right rack leg 320 over a right rack footer 325. A front horizontal beam 330 is attached to upper ends of the left rack leg 310 and the right rack leg 320. Slots 335 across the front side of the horizontal beam 330 allow for hooks 205L, 205R to be attached thereto, so that the suspension bar assembly 200 can be supported by the rack/stand 300.

A left grip dip accessory 340L and a right grip dip accessory 340R can be attached to mid portions of the left rack leg 310 and right rack leg 320 so that the user can grip the dip accessories for further exercises.

The rack/stand 300 provides a stable attach point for the suspension bar assembly outside of a doorframe, and includes two removable structures that permit the execution of dip exercises, and can be subsequently removed for suspension bar assembly exercises.

The user Installation of Suspension Bar Assembly 200 will now be described.

The user installs hooks 205L and 205R into slots 119. Place suspension bar 242 into hooks 50 until ready to exercise.

The user adjustment of the straps will now be described.

Place Left hand on strap free end, thumb of right hand onto cam buckle lever, and pull strap to desired position. Repeat for the second strap. Place hands on bar and level bar to ensure equal loading of appendages during exercise.

The benefits of the suspension bar assembly 200 when attached to pull up assembly 100, rack 300, or bar or structure 400:

1. Includes a cam buckle located at the top of the main strap that provides the user ability to quickly adjust the bar over a range of 60 inches
2. Includes incremental markings on the main strap that allows quick and repeatable bar height adjustments
3. Includes incremental markings on the main strap that allows approximately equal adjustment of the main straps of the suspension bar, allowing the suspension bar to quickly be adjusted to approximately horizontal position.
4. Includes a unique rope attachment method comprised of three rope members passing through a thin metal tube which is cold formed resulting in a permanent connection.
5. Includes a rope passing through the suspension bar with a unique rope attachment method and a bushing which allows the user to quickly perform fine adjustments of the suspension bar to horizontal position
6. Includes a rope passing through the suspension bar with a unique rope attachment method of the two rope ends unto itself and a bushing which allows the suspension bar to rotate with minimal resistive forces eliminating loading on the users' wrists due to rotational reaction forces.
7. Provides the user a means to perform pull up/chin up exercises and suspension exercises with a single apparatus
8. Allows the user to position their body under the suspension attach point, allowing greater usage of user body weight.

Referring to FIG. 12, the suspension bar assembly 200 can be used with other types of prior art pull up bars 400, where the upper loop ends of the first left strap 210L and first right strap 210R can be wrapped thereon to support the suspension bar assembly 200.

Figure 16:
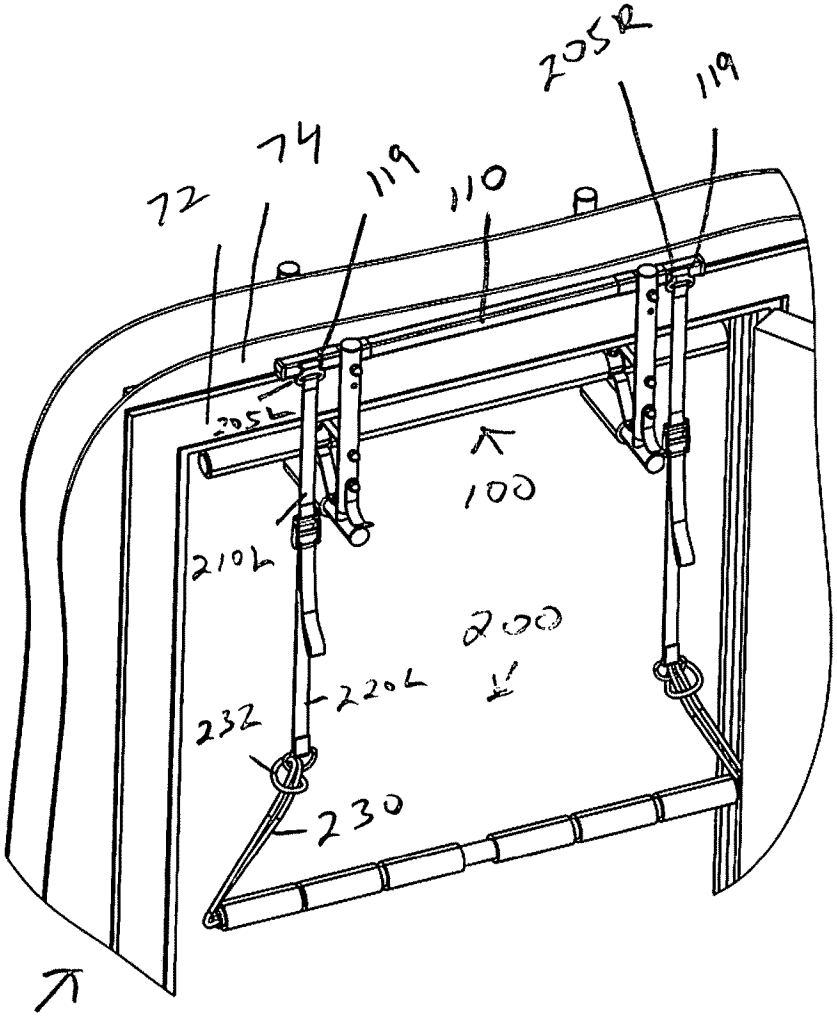
FIG. 16 is an enlarged view of the suspension bar assembly with straps and cord(s) attached to the main pull up bar with cross bars clamped to both sides of a door frame above the trim of FIG. 15.
Figure 15:
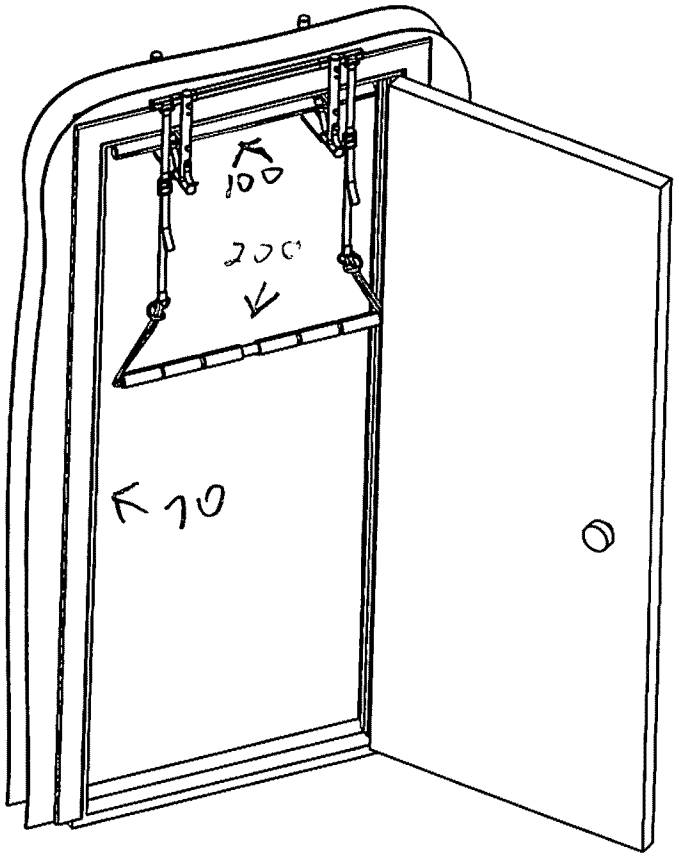
FIG. 15 is an assembled view of the suspension bar assembly with straps and cord(s) of the preceding figures attached to the clamp assembly of FIGS. 4-8 clamped to both sides of a door frame above the trim.

FIG. 15 is an assembled view of the suspension bar assembly 200 with straps 210L, 210R, 220L, 220R and cord(s) 230 of the preceding figures with the clamp assembly 100 of FIGS. 4-8 clamped to both sides of a door frame 70 above the trim 72. FIG. 16 is an enlarged view of the suspension bar assembly 200 with straps 210L, 210R, 220L, 220R and cord(s) 230 clamped to both sides of a door frame 70 above the trim 72 of FIG. 15. Here, the suspension bar assembly 200 can be attached to the first horizontal clamp ledge member 110, by attaching the left strap hook 205L and right strap hook 205R to the slots 119 in the front surface of the first horizontal clamp ledge member 110.

Figure 17:
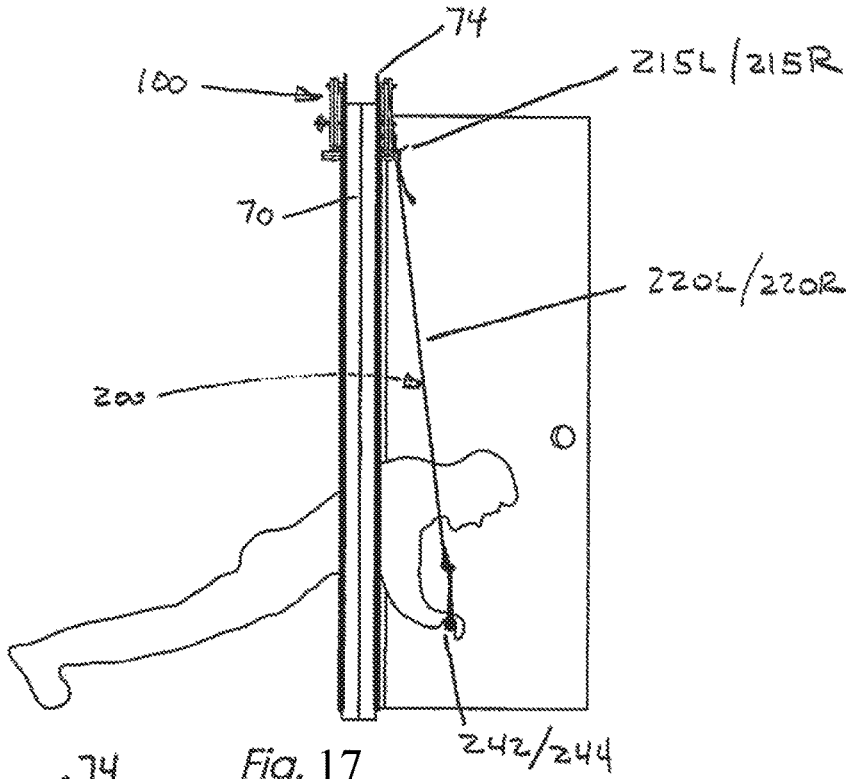
FIG. 17 is a side view of the suspension bar assembly and clamp assembly in a doorway shown in FIGS. 15-16 with a user performing an exercise.

FIG. 17 is a side view of the suspension bar assembly and clamp assembly in a doorway shown in FIGS. 15-16 with a user performing an exercise.

Figure 18:
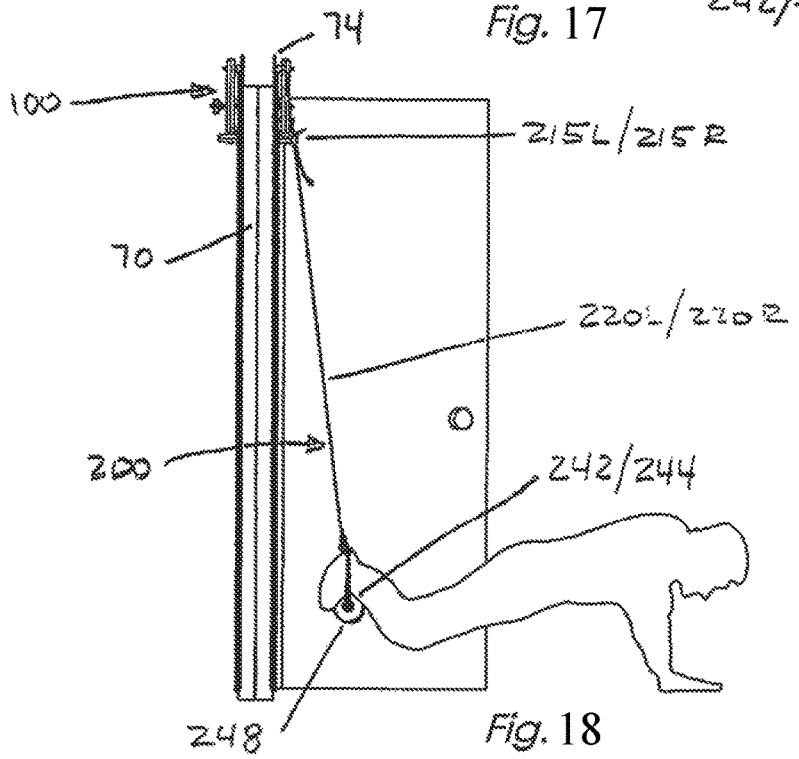
FIG. 18 is another view of FIG. 17 with a cushion block interfacing with the user's foot/leg while performing an exercise.

FIG. 18 is another view of FIG. 17 with a cushion block interfacing with the user's foot/leg while performing an exercise.

Figure 19:
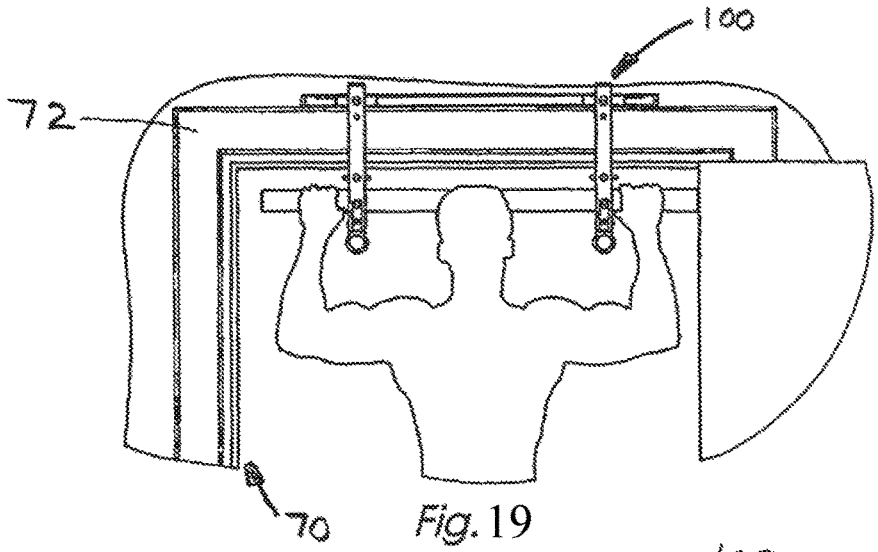
FIG. 19 is another view of the clamp assembly in the doorway of FIG. 5A, with the addition of a user performing a pull up.

FIG. 19 is another view of the clamp assembly in the doorway of FIG. 5A, with the addition of a user performing a pull up.

Figure 20:
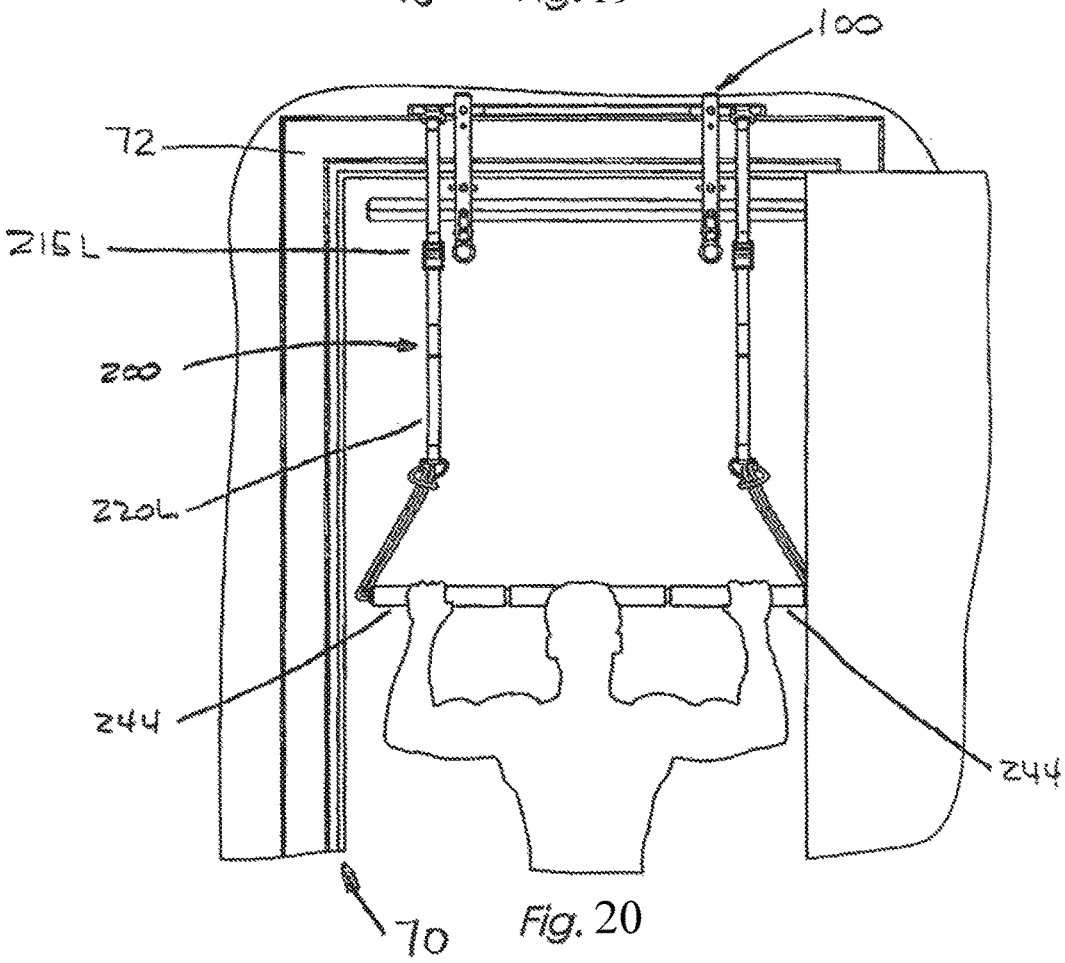
FIG. 20 is a front view of FIG. 16, with the addition of a user performing an exercise.

FIG. 20 is a front view of FIG. 16, with the addition of a user performing an exercise.

Referring to FIGS. 17, 18, and 20, the user can adjust the free end of strap 220L/220R using can buckle 215L/215R such that hollow tube 242 is the appropriate distance from the anchor point to execute the intended exercise. The user can place one or both hands, one or both feet, or any other body part, on cushion sleeve 244, with or without cushion block 248, and proceed with exercise. These figures are only representative of three possible user configurations of the device, and usage of the device is not limited. The device can be used for exercise modes to include pushing, pulling, extending, retracting, jumping, and balancing movements where hollow tube 242 and or the user is behind, in front of, or below the attach point, and the front side of the user's body is oriented towards, away, perpendicular, or at any angle, to the anchor point.

Referring to FIG. 19, the user can place their hands on cushion 16 inside or outside of crossbar 20L or 20R, palms facing towards or away from themselves, and execute a pull up or chin up. Alternatively, the user can place their hands on cushion sleeves 26 and perform a neutral grip pull up.

Figure 21:
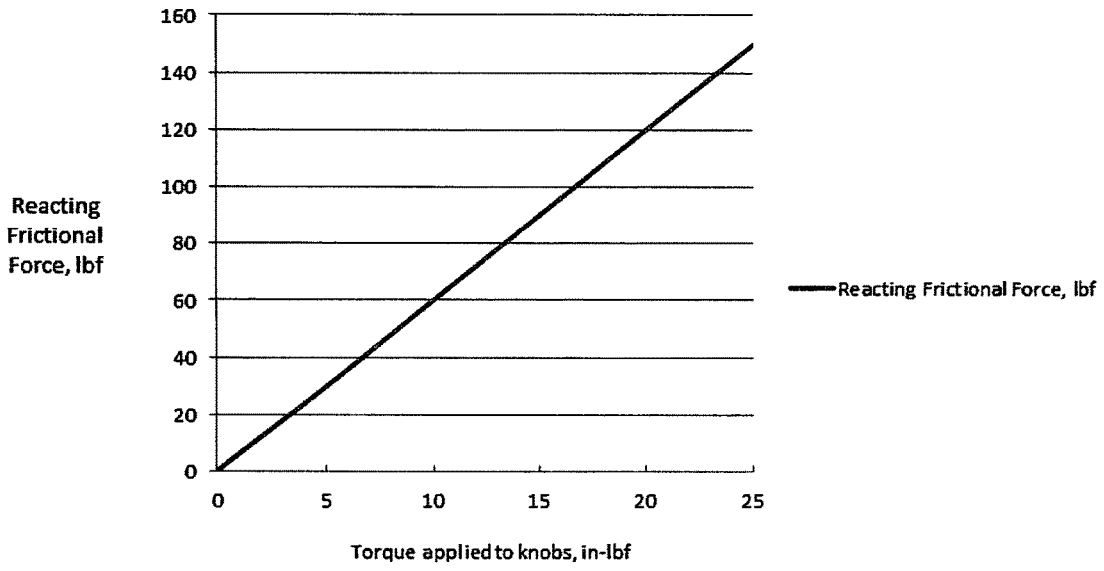
FIG. 21 is a graph of the reacting frictional force, lbf using the clamp assembly.

FIG. 21 is a graph of the reacting frictional force in pounds using the clamp assembly 100. It shows that the frictional force at the clamp-to-wall interface, which reacts the downward force due to the user's body weight, varies directly and approximately linearly with the applied torque to both knobs 152. The reacting frictional force directly lowers the load imparted onto the door trim resulting in a higher margin of safety over failure of trim 72. The graph is representative of a typical installation of clamp assembly 100, consisting of but not limited to the following typical conditions: the clamp-to-wall interface is not wet, the surfaces of wall 74 are approximately parallel, the clamp assembly 100 is properly assembled, and the clamp assembly 100 is properly installed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A pull up exercise device for a door frame, comprising:

a clamp assembly having a first clamp and a second clamp parallel to one another, wherein the first clamp and the second clamp are adapted to clamp to both sides of a door frame above a doorway, and equally distribute a load therefrom; and a pull up bar suspended below the clamp assembly, the pull up bar includes a main pull up bar between and parallel to the first clamp and the second clamp and two cross pull up bars spaced apart from each other and being perpendicular to the main pull up bar; and two M shaped brackets, each M shaped bracket supporting an end of the main pull up bar from each of the cross pull up bars.

2. The pull up exercise device of claim 1, wherein the clamp assembly includes:

vertical support members for attaching the first and second clamps to the cross pull up bars.

3. The pull up exercise device of claim 2, wherein the vertical support members each include plural fastening holes adjacent to upper ends of the vertical support members for adjusting a horizontal height location of the first and second clamps relative to the vertical support members.

4. The pull up exercise device of claim 3, wherein the cross pull up bars each include plural fastening holes adjacent each end of the cross pull up bars for adjusting space distance between the cross pull up bars for different doorway frame thicknesses.

5. A pull up exercise device for a door frame, comprising:

a clamp assembly having a first clamp and a second clamp parallel to one another, wherein the first clamp and the second clamp are adapted to clamp to both sides of a door frame above a doorway, and equally distribute a load therefrom; and a pull up bar suspended below the clamp assembly, wherein the first clamp and the second clamp each include a horizontal ledge member adapted for sitting on top of door way trim on both sides of the door frame; and two elongated straps, each having an upper end and a lower end, with the upper ends being attached to end portions on one of the horizontal ledge members; and a suspension bar attached to the lower end of the elongated straps.

6. The pull up exercise device of claim 5, wherein the clamp assembly includes:

storage hooks attached to a side of the clamp assembly for supporting the suspension bar in a storage position when the suspension bar is not being suspended from the straps.

7. The pull up exercise device of claim 5, further comprising:

an elongated cord having ends attached to the lower ends of each of the elongated straps; and a hollow tube through the suspension bar for allowing the suspension bar to rotate and slide sideways relative to the elongated cord.

8. The pull up exercise device of claim 5, further comprising:

cam buckles for each of the elongated straps for adjusting a length of each of the elongated straps.

9. The pull up exercise device of claim 5, further comprising:

a cushion or cushions shaped to receive arms and legs attached about the suspension bar.

10. A pull up exercise device for a door frame, comprising:

a clamp assembly having a first clamp and a second clamp parallel to one another, the first clamp includes a first top horizontal member and first vertical members coupled to opposing end portions of the first top horizontal member, and the second clamp includes a second top horizontal member and second vertical members coupled to opposing end portions of the second top horizontal member, the first top horizontal member being parallel to and spaced apart from the second top horizontal member and being in a same horizontal plane with one another, and the first vertical members being parallel to one another, and the second vertical members being parallel to and spaced apart from one another, and the first vertical members and the second vertical members being at a same elevation with one another, wherein the first clamp and the second clamp are adapted to clamp to both sides of a door frame above a doorway, and equally distribute a load therefrom; and a pull up bar suspended below the first top horizontal member and the second top horizontal member of the clamp assembly.

11. The pull up exercise device of claim 10, wherein the first clamp and the second clamp each include a horizontal ledge member adapted for sitting on top of door way trim on both sides of the door frame.

12. The pull up exercise device of claim 11, wherein the clamp assembly includes:

two threaded rods for clamping together the first clamp and the second clamp.

13. The pull up exercise device of claim 10, wherein the pull up bar includes:

a main pull up bar between and parallel to the first clamp and the second clamp; and two cross pull up bars spaced apart from each other and being perpendicular to the main pull up bar.

14. A pull up exercise system for a door frame, comprising:

a clamp assembly having a first horizontal ledge clamp and a second horizontal ledge clamp parallel to one another, wherein the first horizontal ledge clamp and the second horizontal ledge clamp are adapted to clamp to both sides of a door frame above a trim of a doorway, and equally distribute a load therefrom;

a first set of vertical support members each having an upper end attached to and extending below the first horizontal ledge clamp;

a second set of vertical support members each having an upper end attached to and extending below the second horizontal ledge clamp; and a pull up assembly having a main pull up bar beneath and parallel to the first horizontal ledge clamp and the second horizontal ledge clamp, and cross pull up bars each perpendicular to the main pull up bar adjacent to and attached to both ends of the main pull up bar, wherein the pull up assembly is attached to lower ends of the first and second sets of vertical support members.

15. The pull up exercise system of claim 14, wherein the first and second sets of vertical support members each include a plurality of through-holes for adjusting height distance between the first and second horizontal ledge clamps and the cross pull up bars.

16. The pull up exercise system of claim 15, wherein the cross pull up bars each include a plurality of through-holes for adjusting space distance between the cross pull up bars for different doorway frame thicknesses.

17. The pull up exercise system of claim 14, further comprising:

M shaped brackets for attaching the main pull up bar to each of the cross pull up bars.

18. The pull up exercise system of claim 14, further comprising:

two threaded rods for clamping the first set of vertical support members to one another and the second set of vertical support members to one another.

* * * * *